US007454926B2

(12) United States Patent
Komatsu et al.

(10) Patent No.: US 7,454,926 B2
(45) Date of Patent: Nov. 25, 2008

(54) WASHING MACHINE

(75) Inventors: Takashi Komatsu, Hyogo (JP); Toyotsugu Matsukura, Nara (JP); Shigeru Matsuo, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 515 days.

(21) Appl. No.: 11/186,839

(22) Filed: Jul. 22, 2005

(65) Prior Publication Data

US 2006/0042328 A1 Mar. 2, 2006

(30) Foreign Application Priority Data

Aug. 26, 2004 (JP) ..... 2004-246672

(51) Int. Cl.
*B08B 3/00* (2006.01)

(52) U.S. Cl. ..... 68/3 R; 68/12.06; 68/12.16; 73/570; 73/579; 73/652

(58) Field of Classification Search ..... 68/3 R, 68/12.06, 12.16; 73/570, 579, 652
See application file for complete search history.

(56) References Cited

U.S. PATENT DOCUMENTS

| | | | | |
|---|---|---|---|---|
| 2,934,925 | A * | 5/1960 | Henshaw, Jr. et al. | 68/12.23 |
| 3,152,462 | A * | 10/1964 | Elliott et al. | 68/12.02 |
| 6,108,488 | A * | 8/2000 | Haner | 388/811 |
| 6,470,751 | B1 | 10/2002 | Baek | |
| 6,640,637 | B2 | 11/2003 | Baek | |
| 6,832,519 | B2 | 12/2004 | Baek | |
| 6,865,947 | B2 | 3/2005 | Baek | |
| 2006/0048549 | A1 * | 3/2006 | Matsukura et al. | 68/12.06 |
| 2006/0053839 | A1 * | 3/2006 | Matsushima et al. | 68/3 R |

FOREIGN PATENT DOCUMENTS

| | | | |
|---|---|---|---|
| CN | 1264828 | A | 8/2000 |
| EP | 1036875 | B1 | 8/2004 |
| GB | 2348961 | A | 10/2000 |
| GB | 2357855 | A | 7/2001 |
| JP | 54-105861 | | 8/1979 |
| JP | 3-264088 | | 11/1991 |
| JP | 06-079098 | | 3/1994 |
| JP | 09-294892 | A | 11/1997 |
| JP | 2000-102690 | A | 4/2000 |
| JP | 2002-277319 | A | 9/2002 |
| JP | 2002-355488 | A | 12/2002 |
| JP | 2003-326093 | | 11/2003 |

* cited by examiner

*Primary Examiner*—Michael Barr
*Assistant Examiner*—Rita R Patel
(74) *Attorney, Agent, or Firm*—Bacon & Thomas, PLLC

(57) ABSTRACT

A washing machine includes a rotary drum for accommodating therein laundry, the rotary drum having a horizontal or slanted rotational axis; a water tub supported in a vibratable manner in a washing machine main body, the rotary drum being installed in the water tub in a rotatable manner; a motor for driving the rotary drum; an input setting unit for setting an operation of the washing machine; a control unit for controlling the motor and the operation of the washing machine set by the input setting unit, the control unit including a microcomputer; and a displacement detection unit for detecting a displacement of the water tub. The displacement detection unit includes an excitation coil, at least two detection coils having an axis coaxially aligned with the excitation coil and a core which can move along the axis.

5 Claims, 9 Drawing Sheets

WASHING MACHINE

FIELD OF THE INVENTION

The present invention relates to a washing machine for performing washing, rinsing and water-extracting processes in a rotary drum having a horizontal or slanted rotational axis; and, more particularly, to a washing machine capable of performing a rotation control by detecting a displacement of the rotary drum at the beginning of a water-extracting process.

BACKGROUND OF THE INVENTION

With regard to a conventional washing machine for performing washing, rinsing and water-extracting processes in a rotary drum having a horizontal or slanted rotational axis, there has been proposed a method for controlling water-extracting rotation by detecting an imbalance of laundry in the rotary drum (see Japanese Patent Laid-Open Application No. 2003-326093).

In accordance with the method disclosed in the above-mentioned application, during a water-extracting process, a rotary drum is accelerated up to a first rotational speed 50 r/min and then slowly accelerated up to a second rotational speed 70 r/min. Thereafter, the rotary drum is accelerated up to a third rotational speed 100 r/min which lies between the second rotational speed and a resonant rotational speed of the rotary drum 120 r/min and controlled to maintain the third rotational speed for a certain time. At this time, a first imbalance detection S1 is performed. In case a result of the first imbalance detection S1 indicates a low degree of rotational unevenness, thereby drawing a conclusion that an inside of the rotary drum is not in a state of laundry imbalance, the rotary drum is accelerated up to a fourth rotational speed 170 r/min and a second imbalance detection S2 is performed in a similar manner as the first imbalance detection S1.

In case it is concluded from the second imbalance detection S2 that the laundry of the rotary drum is not placed in an imbalanced state, the rotary drum is accelerated up to 900 r/min which is a steady-state rotational speed of a high-speed range in the water-extracting process, and then, the steady-state rotational speed is maintained for a certain time. Thereafter, the rotary drum is stopped to finish the water-extracting process.

However, there are drawbacks in the conventional method for detecting laundry imbalance based on rotational unevenness of a rotational drum, which is employed by the above-mentioned conventional washing machine, in that a detection process thereof is performed in an indirect manner and, in addition, an accuracy thereof is not sufficient for discerning, e.g., differences in laundry or installation conditions of the washing machine.

SUMMARY OF THE INVENTION

It is, therefore, an object of the present invention to provide a washing machine capable of attenuating vibration or noise during a water-extracting process by detecting vibration of a water tub during a water-extracting process at a high accuracy, wherein the vibration is generated due to an imbalanced distribution of laundry in the rotary drum having a horizontal or slanted rotational axis.

In accordance with the present invention, there is provided a washing machine comprising: a rotary drum for accommodating therein laundry, the rotary drum having a horizontal or slanted rotational axis; a water tub supported in a vibratable manner in a washing machine main body, the rotary drum being installed in the water tub in a rotatable manner; a motor for driving the rotary drum; an input setting unit for setting an operation of the washing machine; a control unit for controlling the motor and the operation of the washing machine set by the input setting unit, the control unit including a microcomputer; and a displacement detection unit for detecting a displacement of the water tub, the displacement detection unit including an excitation coil, at least two detection coils having an axis coaxially aligned with the excitation coil and a core which can move along the axis, wherein one of the detection coils and the core can move pursuant to the displacement of the water tub, wherein an end of the excitation coil is coupled to an end of one of the detection coils as well as an end of the other of the detection coils, forming a neutral point connecting to a 0V voltage reference of a power of the microcomputer.

With this configuration, a magnitude of water tub vibration due to laundry imbalance in the rotary drum can be directly detected in the form of a magnitude of a displacement thereof by a displacement detection unit, an output voltage of which can be directly detected by a microcomputer installed in a controller, thereby making it possible to detect the vibration during a water-extracting process at a high accuracy without time delay so that a control of motor rotation can be performed based on the detection result to substantially attenuate vibration and noise during the water-extracting process.

The washing machine in accordance with the present invention can directly detect water tub vibration generated due to laundry imbalance, such vibration being conspicuous especially in a drum-type washing machine, so that it can unfailingly attenuate vibration or noise during a water-extracting process.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENT

In accordance with the present invention, there is provided a washing machine including a rotary drum for accommodating therein laundry, the rotary drum having a horizontal or slanted rotational axis; a water tub supported in a vibratable manner in a washing machine main body, the rotary drum being installed in the water tub in a rotatable manner; a motor for driving the rotary drum; an input setting unit for setting an operation of the washing machine; a control unit for controlling the motor and the operation of the washing machine set by the input setting unit, the control unit including a microcomputer; and a displacement detection unit for detecting a displacement of the water tub, the displacement detection unit including an excitation coil, at least two detection coils having an axis coaxially aligned with the excitation coil and a core which can move along the axis, wherein one of the detection coils and the core can move pursuant to the displacement of the water tub, wherein an end of the excitation coil is coupled to an end of one of the detection coils as well as an end of the other of the detection coils, all of the ends connecting to a 0V voltage reference of a power of the microcomputer.

Hereinafter, preferred embodiments in accordance with the present invention will be described with reference to the accompanying drawings. However, the present invention should not be construed to be limited thereto.

First Preferred Embodiment

Figure 1:
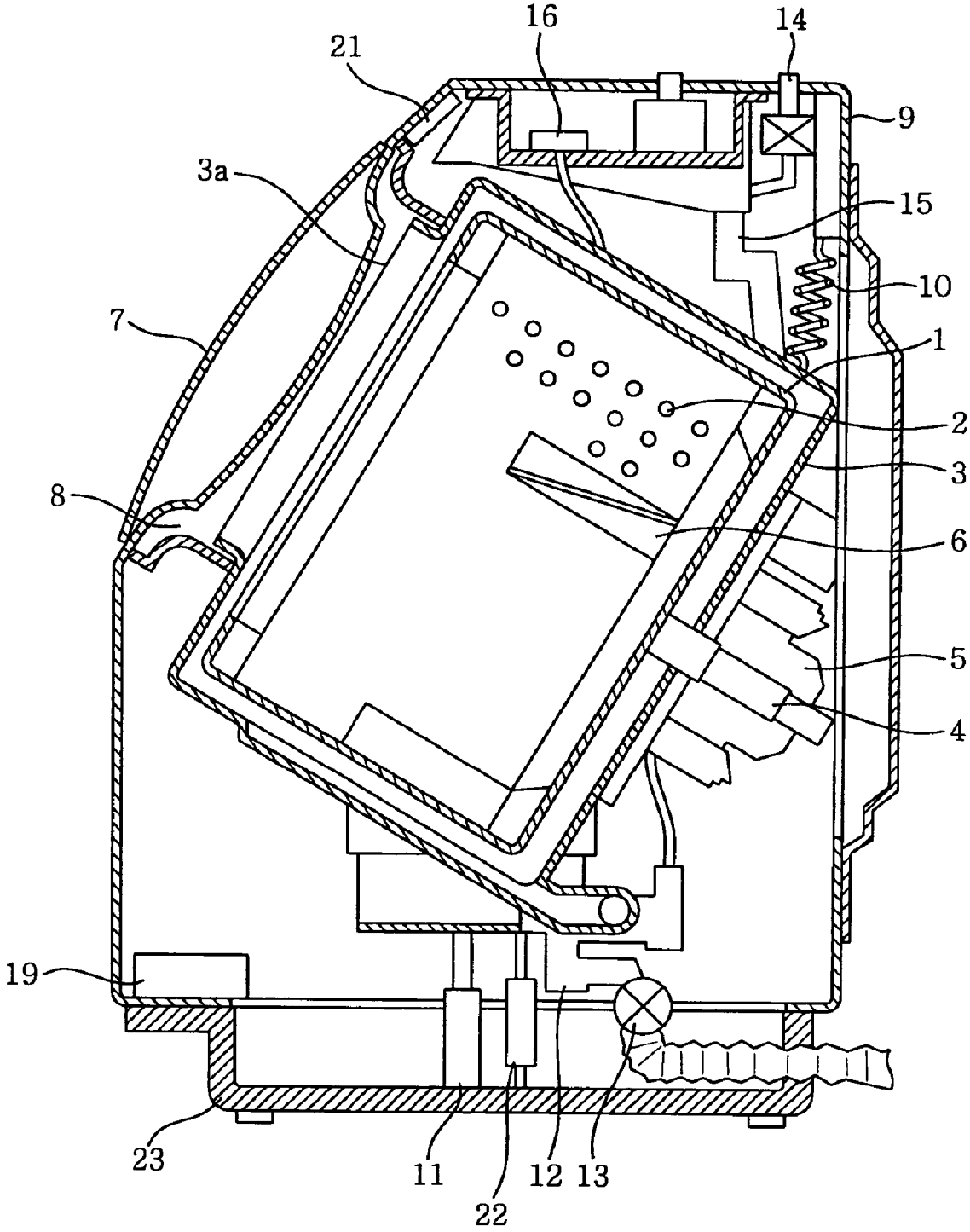
FIG. 1 shows a side cross sectional view of a washing machine in accordance with a first embodiment of the present invention.
Figure 2:
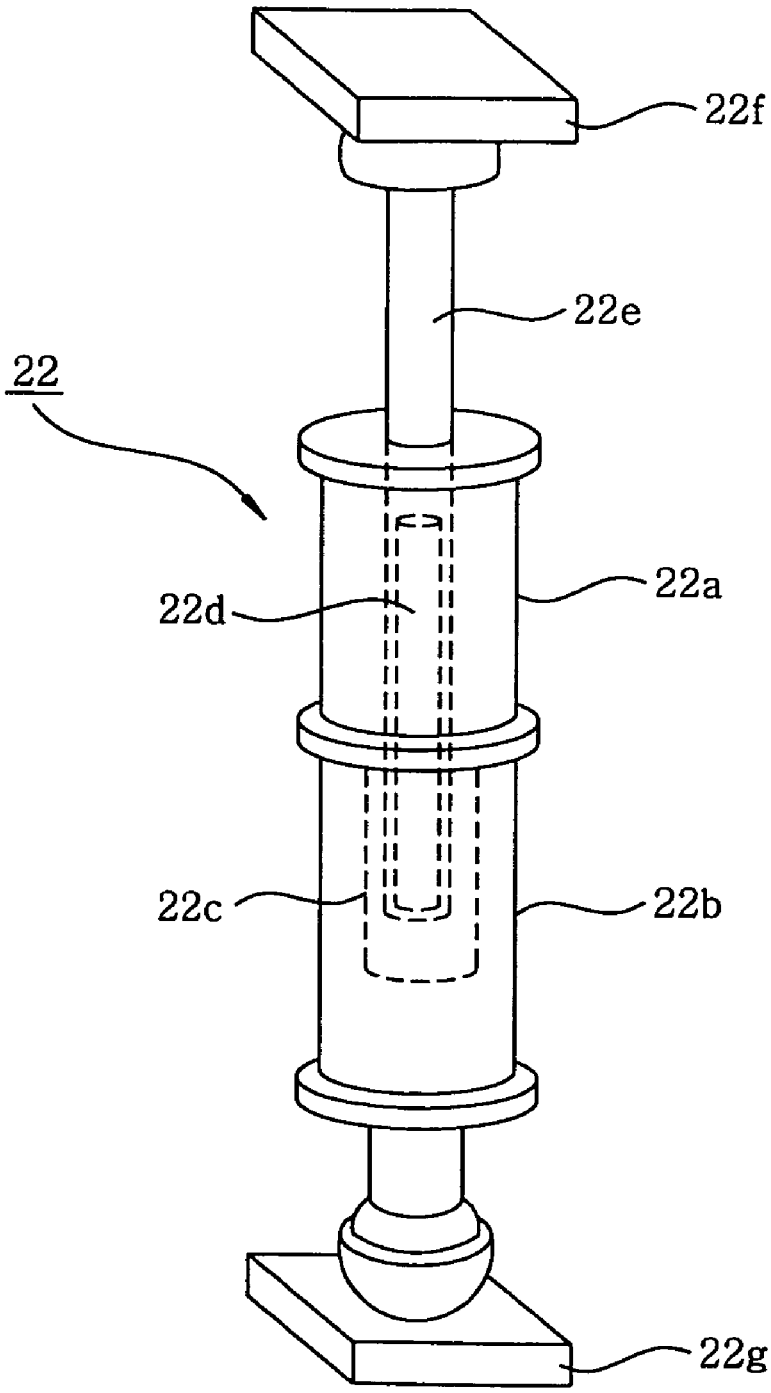
FIG. 2 describes a perspective view of a displacement detection sensor in the washing machine in accordance with the first embodiment of the present invention.
Figure 3:
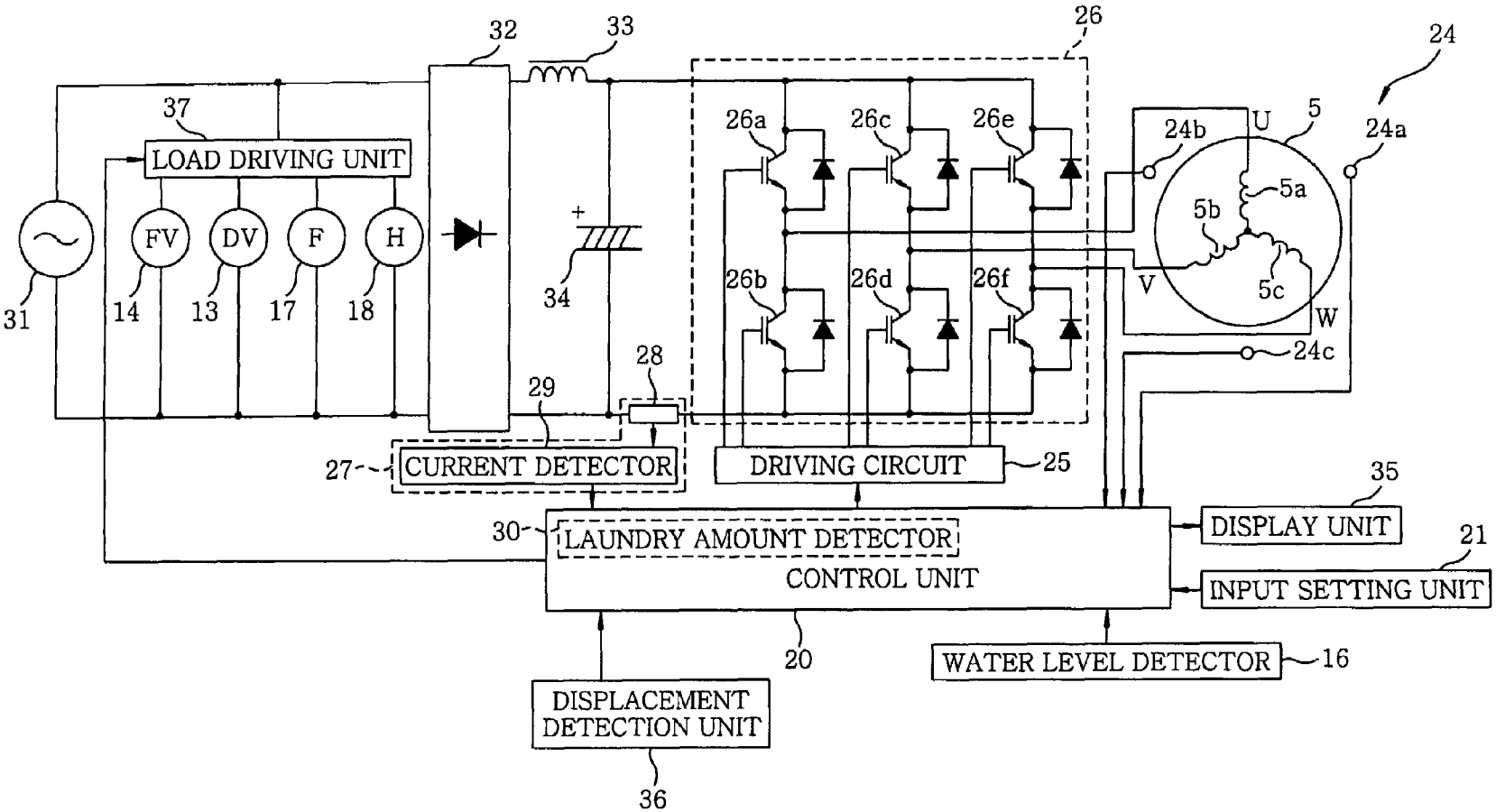
FIG. 3 provides a block diagram of the washing machine in accordance with the first embodiment of the present invention.
Figure 4:
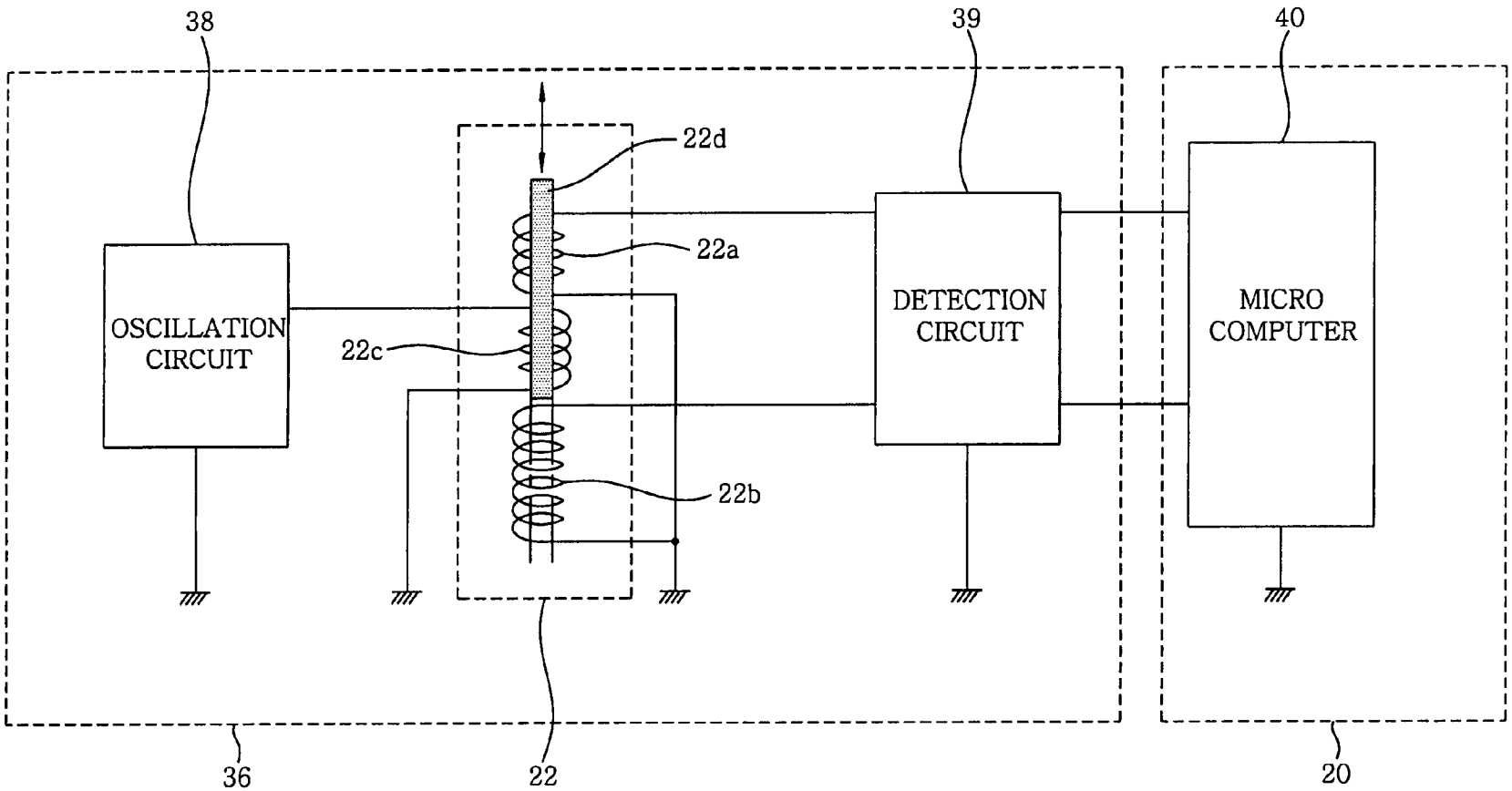
FIG. 4 represents a detailed block diagram of a displacement detection unit in the washing machine in accordance with the first embodiment of the present invention.

FIG. 1 shows a side cross sectional view of a washing machine in accordance with a first embodiment of the present invention; FIG. 2 describes a perspective view of a displacement detection sensor in the washing machine in accordance with the first embodiment of the present invention; FIG. 3 provides a block diagram of the washing machine in accordance with the first embodiment of the present invention; and FIG. 4 represents a block diagram of a displacement detection unit in the washing machine in accordance with the first embodiment of the present invention.

As shown in FIGS. 1 to 4, cylindrical rotary drum 1 having a base is rotatably installed in water tub 3. Rotary drum 1, which has a plurality of drum perforations 2 on its entire cylindrical surface and rotating shaft (central axis of rotation) 4 at its center of rotation, is disposed such that its central axis of rotation is declined toward the rear portion of the washing machine. Motor 5 installed at the rear side of water tub 3 is connected to rotating shaft 4 to rotate rotary drum 1 in forward and reverse direction. Further, a number of agitation blades 6 are disposed on the inner cylindrical surface of rotary drum 1.

Opening 3*a* formed at an inclined frontal surface of water tub 3 can be opened and closed with door 7. By opening door 7, laundry can be loaded into or unloaded from rotary drum 1 through laundry loading/unloading opening 8. Since door 7 is installed at an inclined surface, loading and unloading of laundry can be performed without a user having to bend down considerably.

Water tub 3 is supported in washing machine main body 9 by spring 10 and damper 11 so that it can rock back and forth. Connected to the lower portion of water tub 3 is one end of water drain conduit 12, and the other end of water drain conduit 12 is coupled to water drain valve 13 to drain wash water from water tub 3.

Displacement detection sensor (displacement detection unit) 22 for detecting a displacement of water tub 3 is installed in the vicinity of damper 11 in such a manner that it can move pursuant to vertical movement of water tub 3. Underframe 23 supports washing machine main body 9 and every element placed therein.

Moreover, there are provided water feed valve 14 for feeding water into water tub 3 via water supply conduit 15 and water level detection unit 16 for detecting a water level in water tub 3.

Further, although, in the above-described embodiment, rotary drum 1 having rotating shaft 4 at its center of rotation is installed such that its central axis of rotation is declined toward the rear portion of the washing machine, rotary drum 1 with rotating shaft 4 may be set up such that its central axis of rotation is oriented horizontally.

As shown in FIG. 2, displacement detection sensor 22 has first detection coil 22*a*, second detection coil 22*b* and excitation coil 22*c* (which is winded inside first detection coil 22*a*), each of which has an axis coaxially aligned with each other. At the center of the axis, a shaft 22*e* having core 22*d* therein is slidably installed. Upper mounting table 22*f* is attached to water tub 3 as shown in FIG. 1 and lower mounting table 22*g* is adhered to underframe 23.

In addition, though not shown in FIG. 1, washing machine main body 9 further houses therein fan 17 for circulating warm air into rotary drum 1 and heater 18 for generating the warm air (see FIG. 3), so that the washing machine can further have a drying function for drying laundry in rotary drum 1.

As shown in FIG. 3, control unit 19 includes controller 20 with a microcomputer for controlling a series of operations including washing, rinsing, water-extracting and drying processes in sequence as well as controlling the operations of motor 5, water drain valve (DV) 13, water feed valve (FV) 14, fan (F) 17, heater (H) 18 and so forth.

Controller 20 inputs information from input setting unit 21 for setting, e.g., a certain operation course and informs a user of the information through display unit 35. Once an operation is set to start by input setting unit 21, controller 20 controls the operations of water drain valve 13, water feed valve 14, fan 17 and heater 18 via load driving unit 37 based on input data sent from, e.g., water level detector 16 for detecting a water level in water tub 3, thereby carrying out washing and drying operations.

At this time, controller 20 controls the rotation of motor 5 by controlling inverter 26 via driving circuit 25 based on information sent from position detecting units 24 (24*a*, 24*b*, 24*c*) which detect a position of a rotor of motor 5. Though not shown, motor 5 is a brushless DC motor including a stator with three-phase windings and a rotor with a bipolar permanent magnet disposed on a ring. The stator includes three-phase windings comprised of first winding 5*a*, second winding 5*b* and third winding 5*c* wound around an iron core having slots.

Inverter 26 includes switching devices each of which has a parallel circuit of a power transistor (e.g., insulated gate bipolar transistor (IGBT)) and a reverse conducting diode. Each of the switching devices includes a serial circuit of first and second switching devices 26*a* and 26*b*; a serial circuit of third and fourth switching devices 26*c* and 26*d*; and a serial circuit of fifth and sixth switching devices 26*e* and 26*f*, wherein the serial circuits are connected to each other in parallel.

Here, both ends of each of the serial circuits serve as input terminals and are coupled to a DC power supply. Further, respectively coupled to a junction of the two switching devices in each serial circuit are output terminals, which are in turn connected to U terminal, V terminal and W terminal of the three-phase windings, respectively. The U, V and W terminals are controlled to be set in a positive voltage, a zero voltage and a floating state, respectively, by properly combining on-off operations of the two switching devices in each serial circuit.

The on-off operations of the switching devices are controlled by controller 20 based on information from three position detecting units 24*a* to 24*c* implemented by employing a hall IC. Position detecting units 24*a* to 24*c* are disposed at the stator at intervals of an electrical angle of 120 degrees to face the permanent magnet provided in the rotor.

While the rotor makes one revolution, each of three position detecting units 24*a* to 24*c* outputs a pulse at intervals of the electrical angle of 120 degrees. Controller 20 checks if at least one of three position detecting units 24*a* to 24*c* has changed its state, and when a change of the state is detected, controller 20 changes the on-off states of the switching devices 23*a* to 23*f* based on the signals from position detecting units 24*a* to 24*c*, thereby setting the U, V and W terminals to be in a positive voltage, a zero voltage and a floating state, respectively. A magnetic field is formed by supplying thus controlled electric power to first, second and third windings 5*a* to 5*c* of the stator, thereby rotating the rotor.

Further, each of switching devices 26*a*, 26*c* and 26*e* is subjected to pulse width modification (PWM), and the number of rotations of the rotor is controlled by, for example, adjusting a duty ratio at a frequency of 10 kHz. Whenever a signal state changes in at least one of three position detecting units 24*a* to 24*c*, controller 20 detects the period thereof, calculates the number of rotations of the rotor based on the detected period, and then performs the PWM control of switching devices 26*a*, 26*c* and 26*e* such that the rotor makes as many rotations as the set rotation number.

Current detector 27, which includes resistor 28 connected to an input terminal of inverter 26 and current detecting circuit 29 coupled to resistor 28, detects an input current of inverter 26 and supplies an output voltage thereof to controller 20. In case motor 5 is a brushless DC motor, its torque is substantially proportional to its input current. Thus, the torque of motor 5 can be obtained by detecting the input current of inverter 26 through the use of current detecting circuit 26 connected to resistor 28.

Laundry amount detector 30 detects the amount of laundry in rotary drum 1 based on a signal transmitted from current detector 27 when rotary drum 1 is driven at a specific rotational speed (e.g., 200 r/min).

Commercial power source 31 is connected to inverter 26 via a DC power converter including diode bridge 32, choke coil 33 and smoothing capacitor 34 for example. It is to be noted that the configuration described above is only one example, and the configurations of brushless DC motor 5, inverter 26, and so forth should not be construed as limited thereto.

Input setting unit 21, although not shown, includes a washing time setting switch for setting a washing time period, a rinsing number setting switch for setting the number of rinsing operations, a water-extracting time setting switch for setting a water-extracting time period, a drying time setting switch for setting a drying time period, a start/pause switch, a power-on switch, a power-off switch and a course setting switch.

Display unit 35 includes, although not shown, a washing time display subunit, a rinsing number display subunit, a drying time display subunit and a course setting display subunit. Display unit 35, further including a number display unit, can display an amount of detergent and a remaining time.

Displacement detection unit 36, shown in FIG. 3, includes oscillation circuit 38 coupled to excitation coil 22*c* in displacement detection sensor 22 and detection circuit 39 connected to first detection coil 22*a* and second detection coil 22*b*, as particularly illustrated in FIG. 4. An output signal from detection circuit 39 is provided to microcomputer 40 included in controller 20.

Further, an end of excitation coil 22*c* is coupled to an end of first detection coil 22*a* as well as an end of second detection coil 22*b*, forming a neutral point having a reference voltage 0V in common with microcomputer 40, thereby preventing a voltage variance among them.

Hereinafter, there will be given explanation as to how the washing machine with this configuration operates.

When a water-extracting process is performed after laundry having been loaded into rotary drum 1, and, if the laundry are in an imbalance state, rotary drum 1 does not rotate in a manner that rotating shaft 4 keeps in a same position, but moves up and down, left and right and back and forth. Then, water tub 3 moves in the same manner as the rotary drum 1 so that a movement, mainly a vertical movement, is detected by displacement detection sensor 22 and a displacement signal of water tub 3 is sent to microcomputer 40 in controller 20 via displacement detection unit 36.

Considering that the displacement signal of the water tub 3 indicates an imbalance of laundry in rotary drum 1, vibration or noise of the washing machine can be reduced during a drying process through the use of controller 20, which gives a command signal to motor 5 via driving circuit 25 and inverter 26 that the water-extraction process be stopped or that the number of revolutions be changed in case the imbalance is assessed to be greater than a predetermined threshold.

Second Preferred Embodiment

Figure 5:
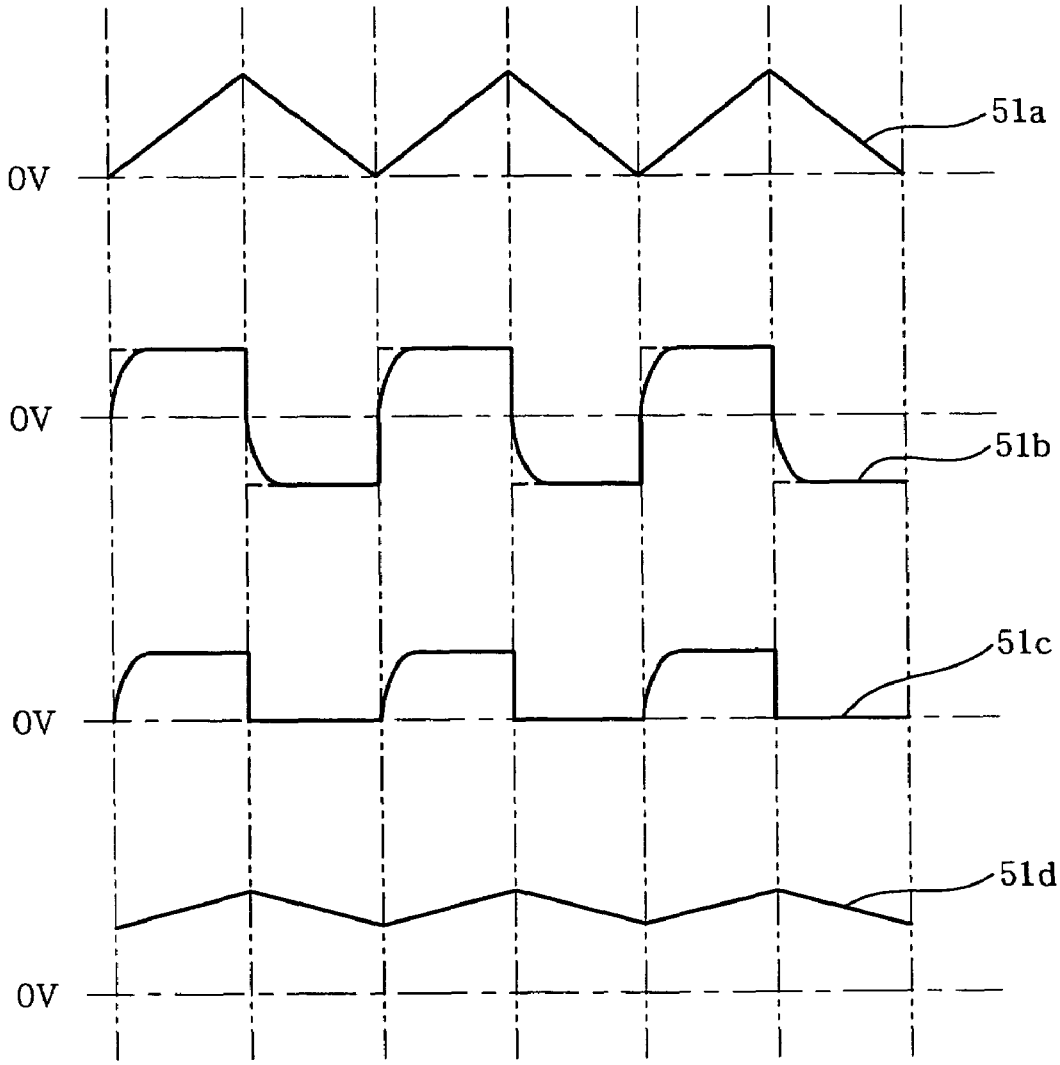
FIG. 5 offers a waveform chart for showing waveforms at each part of a displacement detection unit during an operation of a washing machine in accordance with a second embodiment of the present invention.

FIG. 5 is a waveform chart for showing waveforms at each part of a displacement detection unit during an operation of a washing machine in accordance with a second embodiment of the present invention. In the following, elements thereof which are same as the first embodiment will be given the same reference numerals as the first embodiment and an explanation thereof will be abridged.

In FIG. 5, waveform 51*a* is applied to excitation coil 22*c*, waveform 51*b* is outputted from first detection coil 22*a* and second detection coil 22*b*, waveform 51*c* is a half-wave rectified signal which is being processed in detection circuit 39 and waveform 51*d* is that of a smoothed signal outputted from detection circuit 39. Except for this, the configuration of the second embodiment is same as the first embodiment.

In the following, there will be given a description on an operation of displacement detection unit 36 with this configuration.

First, a triangular waveform, exemplified by waveform 51*a*, is applied to excitation coil 22*c* as shown in FIG. 5. The triangular waveform can be generated by oscillation circuit 38 with a relatively simple circuit configuration having, for example, a couple of operational amplifiers, although not shown. Applying the triangular waveform to excitation coil 22*c*, a differentiation process occurs with regard to the applied waveform in first detection coil 22*a* so that a waveform similar to a partially smoothed square wave is generated as exemplified by waveform 51*b*. A waveform substantially identical to waveform 51*b* is generated in second detection coil 22*b*.

Thereafter, the generated waveform is subject to a half-wave rectification and then smoothed by detection unit 39 as illustrated by waveforms 51*c* and 51*d*. The waveform obtained by this process is provided to, e.g., an AD converter in microcomputer 40, thereby transferring information on the displacement detected by displacement detection sensor 22 to controller 20.

As described above, in accordance with the second embodiment of the present invention, stable output characteristics can be obtained with a simple circuit configuration by using a triangular waveform.

Third Preferred Embodiment

Figure 6:
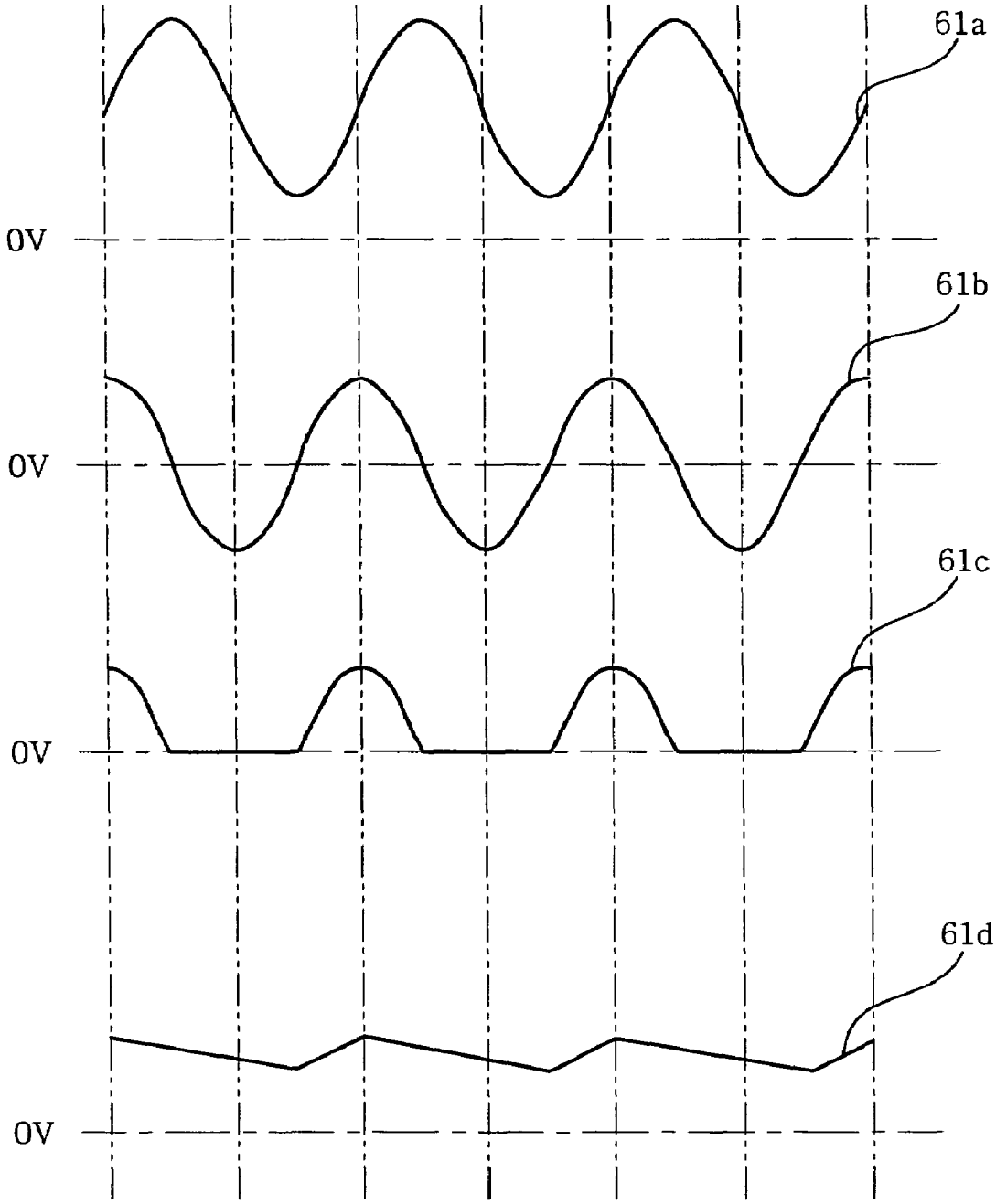
FIG. 6 is a waveform chart for showing waveforms at each part of a displacement detection unit during an operation of a washing machine in accordance with a third embodiment of the present invention.

FIG. 6 is a waveform chart for showing waveforms at each part of a displacement detection unit during an operation of a washing machine in accordance with a third embodiment of the present invention. In the following, elements thereof which are same as the first embodiment will be given the same reference numerals as the first embodiment and an explanation thereof will be abridged.

In FIG. 6, waveform 61*a* is applied to excitation coil 22*c*, waveform 61*b* is outputted from first detection coil 22*a* and second detection coil 22*b*, waveform 61*c* is a half-wave rectified signal which is being processed in detection circuit 39 and waveform 61*d* is that of a smoothed signal outputted from detection circuit 39. Except for this, the configuration of the third embodiment is same as the first embodiment.

In the following, there will be given a description on an operation of displacement detection unit 36 with this configuration.

First, a sinusoidal waveform, exemplified by waveform 61*a*, is applied to excitation coil 22*c* as shown in FIG. 6. The sinusoidal waveform can be generated by oscillation circuit 38 with a relatively simple circuit configuration, although not shown. Applying the sinusoidal waveform to excitation coil 22*c*, a differentiation process occurs with regard to the applied waveform in first detection coil 22*a*, thereby generating a waveform having the same shape as the waveform 61*b* except that a phase thereof is shifted. A waveform substantially identical thereto is generated in second detection coil 22*b*.

Thereafter, the generated waveform is subject to a half-wave rectification and then smoothed by detection circuit 39 as illustrated by waveforms 61*c* and 61*d*. The waveform obtained by this process is provided to, e.g., an AD converter in microcomputer 40, thereby transferring information on the displacement detected by displacement detection sensor 22 to controller 20.

As described above, in accordance with the third embodiment of the present invention, temperature-insensitive and stable output characteristics can be obtained by applying a sinusoidal waveform to excitation coil 22*c* because the sinusoidal waveform does not change its shape even after going through displacement detection sensor 22.

Fourth Preferred Embodiment

Figure 7:
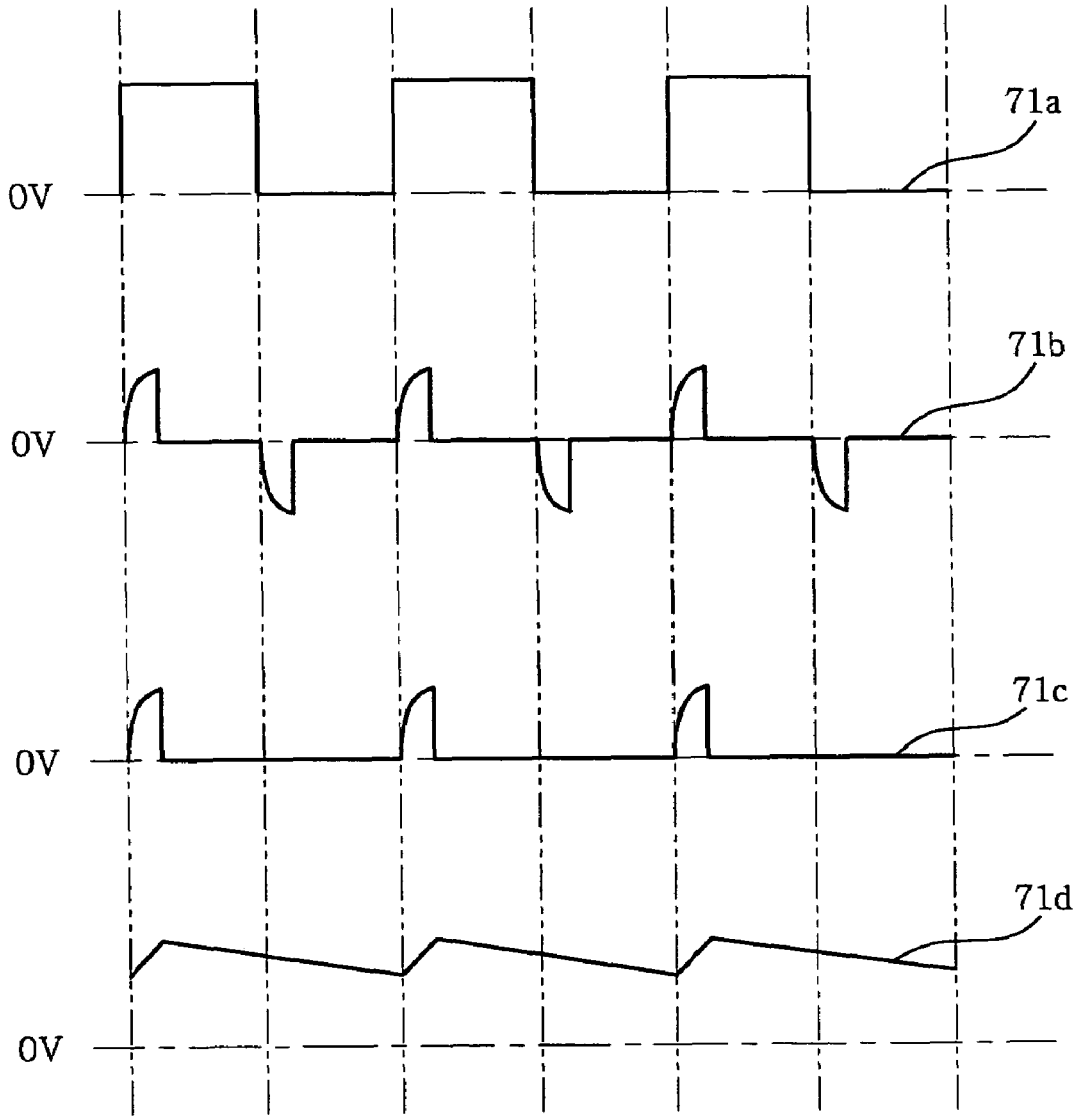
FIG. 7 presents a waveform chart for showing waveforms at each part of a displacement detection unit during an operation of a washing machine in accordance with a fourth embodiment of the present invention.

FIG. 7 is a waveform chart for showing waveforms at each part of a displacement detection unit during an operation of a washing machine in accordance with a fourth embodiment of the present invention. In the following, elements thereof which are same as the first embodiment will be given the same reference numerals as the first embodiment and an explanation thereof will be abridged.

In FIG. 7, waveform 71*a* is applied to excitation coil 22*c*, waveform 71*b* is outputted from first detection coil 22*a* and second detection coil 22*b*, waveform 71*c* is a half-wave rectified signal which is being processed in detection circuit 39 and waveform 71*d* is that of a smoothed signal outputted from detection circuit 39. Except for this, the configuration of the fourth embodiment is same as the first embodiment.

In the following, there will be given a description on an operation of displacement detection unit 36 with this configuration.

First, a square waveform, exemplified by waveform 71*a*, is applied to excitation coil 22*c* as shown in FIG. 7. Applying the square waveform to excitation coil 22*c*, a differentiation process occurs with regard to the applied waveform in first detection coil 22*a* so that a waveform having high peaks and narrow widths is generated as exemplified by waveform 71*b*. The peak of waveform 71*b* can be set by adjusting a time constant of oscillation circuit 38 or a winding ratio of each coil in displacement detection sensor 22. A high voltage can be obtained easily through the application of the above method. A waveform substantially identical thereto is generated in second detection coil 22*b*.

Thereafter, the generated waveform is subject to a half-wave rectification and then smoothed by detection circuit 39 as illustrated by waveforms 71*c* and 71*d*. The waveform obtained by this process is provided to, e.g., an AD converter in microcomputer 40, thereby transferring information on the displacement detected by displacement detection sensor 22 to controller 20.

As described above, in accordance with the fourth embodiment of the present invention, a high output can be obtained with a simple circuit configuration and a sensitivity of displacement detection unit 36 can be enhanced through the application of a square waveform to excitation coil 22*c*.

Fifth Preferred Embodiment

Figure 8:
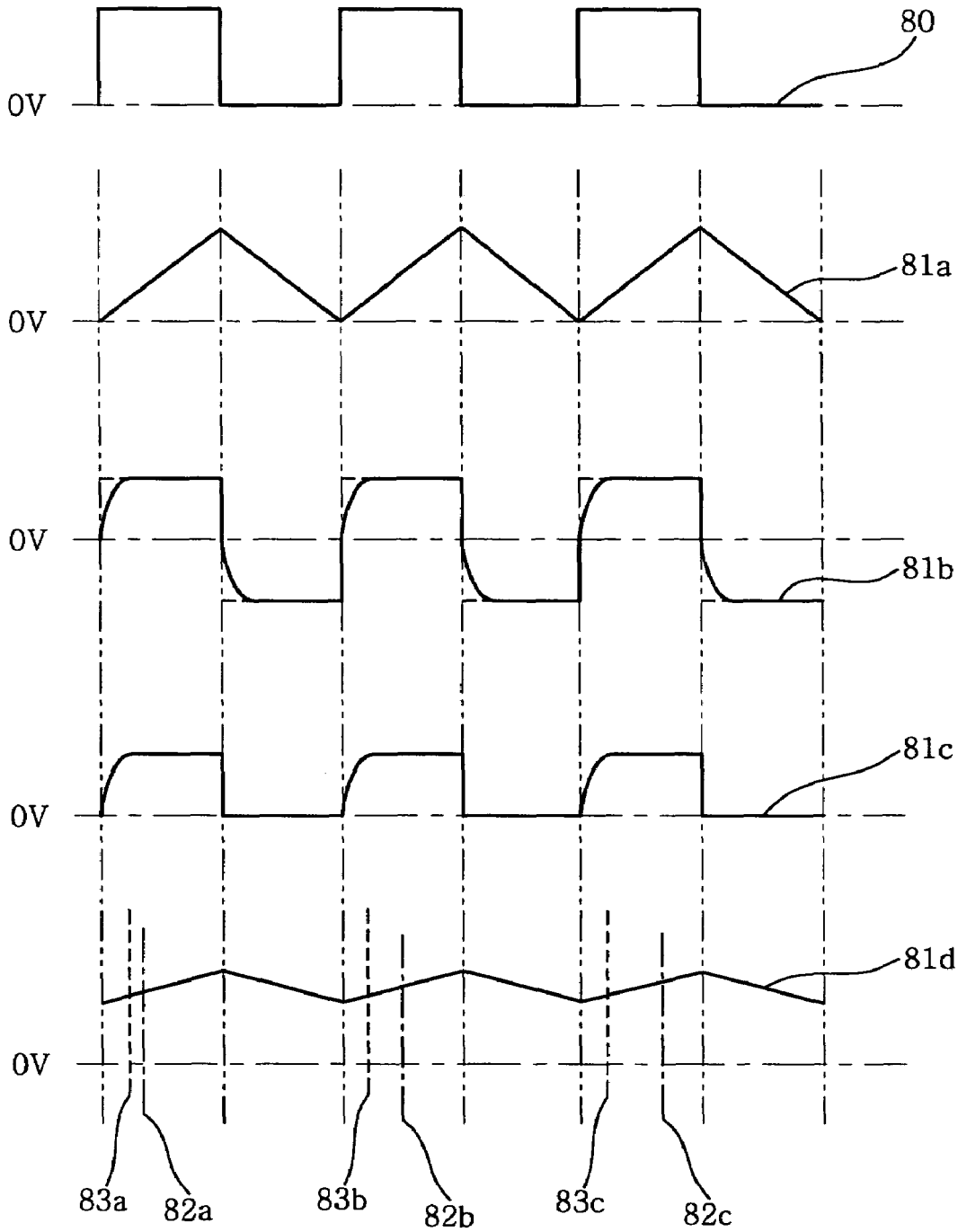
FIG. 8 provides a waveform chart for showing waveforms at each part of a displacement detection unit during an operation of a washing machine in accordance with a fifth embodiment of the present invention.
Figure 9:
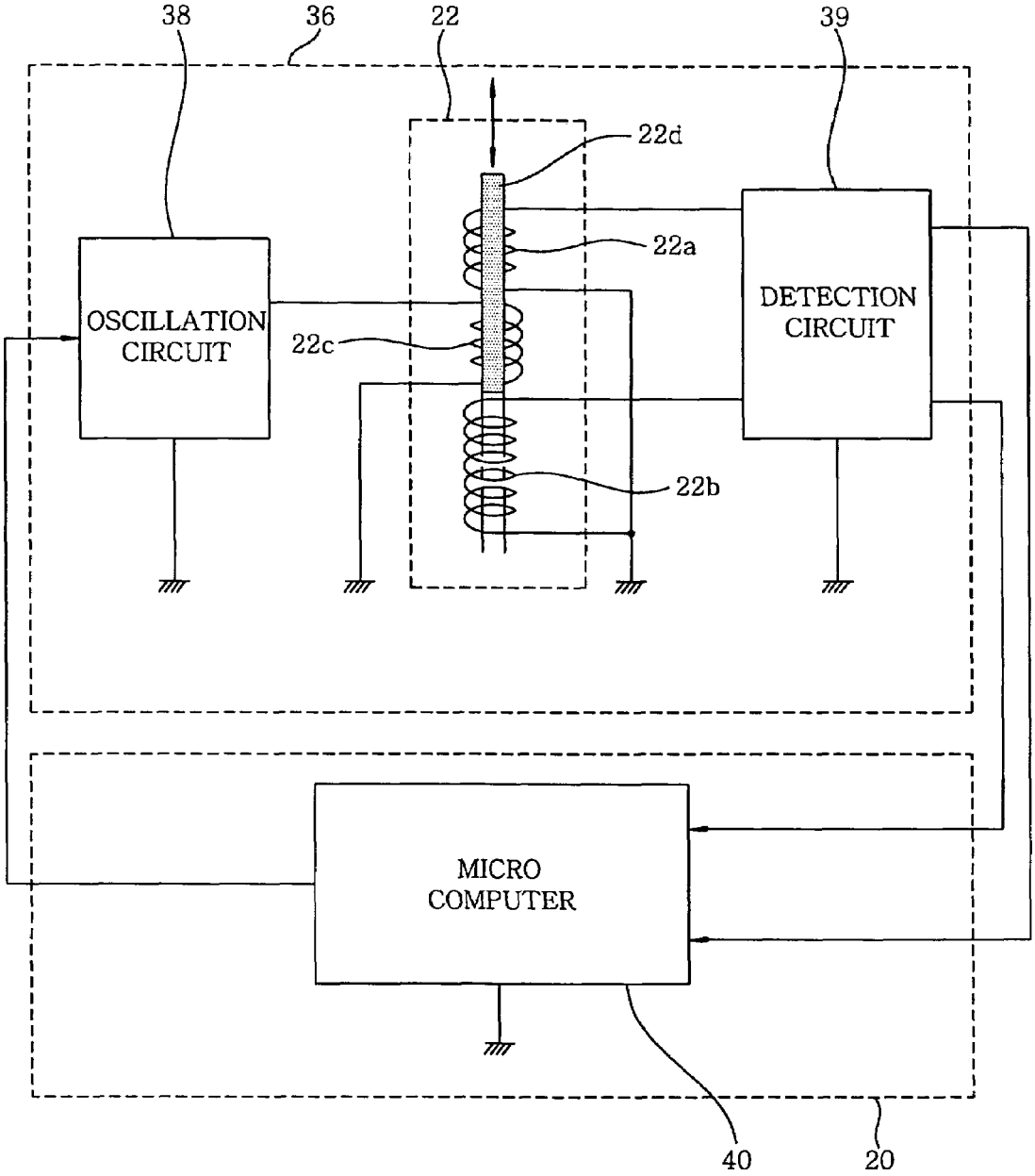
FIG. 9 illustrates a detailed block diagram of the displacement detection unit in the washing machine in accordance with the fifth embodiment of the present invention.

FIG. 8 provides a waveform chart for showing waveforms at each part of a displacement detection unit during an operation of a washing machine in accordance with a fifth embodiment of the present invention; and FIG. 9 illustrates a detailed block diagram of the displacement detection unit. In the following, elements thereof which are same as the first embodiment will be given the same reference numerals as the first embodiment and an explanation thereof will be abridged.

In FIG. 8, waveform 80 is a synchronizing signal sent from microcomputer 40 to oscillation circuit 38, as shown in FIG. 9, waveform 81*a* is applied to excitation coil 22*c*, waveform 81*b* is outputted from first detection coil 22*a* and second detection coil 22*b*, waveform 81*c* is a half-wave rectified signal which is being processed in detection circuit 39 and waveform 81*d* is that of a smoothed signal outputted from detection circuit 39. Except for this, the configuration of the fifth embodiment is same as the first embodiment.

In the following, there will be given a description on an operation of displacement detection unit 36 with this configuration.

First, a triangular waveform, exemplified by waveform 81*a*, is applied to excitation coil 22*c* as shown in FIG. 8. Although not illustrated, the triangular waveform can be generated by oscillation circuit 38 with a relatively simple circuit configuration having, for example, a couple of operational amplifiers. Applying the triangular waveform to excitation coil 22*c*, a differentiation process occurs with regard to the applied waveform in first detection coil 22*a* so that a waveform similar to a partially smoothed square wave is generated as exemplified by waveform 81*b*. A waveform substantially identical to waveform 81*b* is generated in second detection coil 22*b*.

Thereafter, the generated waveform is subject to a half-wave rectification and then smoothed by detecting circuit 39 as illustrated by waveforms 81*c* and 81*d*. The waveform obtained by this process is provided to, e.g., an AD converter in microcomputer 40, thereby transferring information on the displacement detected by displacement detection sensor 22 to controller 20.

Herein, if a period of waveform 81*a* outputted from oscillation circuit 38 and a period of read-out operations in microcomputer 40 are not synchronized to each other, microcomputer 40 reads waveform 81*d* such that a phase of waveform 81*d* at a read-out time is different from that at a previous read-out time. For example, read-out operations on waveform 81*d* are performed at a first read-out time 82*a*, a second read-out time 82*b* and a third read-out time 82*c*, as shown in FIG. 8. As a result, an inconsistency or instability may occur among a plurality of read-out data.

In order to solve this problem, a synchronizing signal such as waveform 80 shown in FIG. 8 is sent from microcomputer 40 to oscillation circuit 38 so that a waveform to be read, i.e., waveform 81*d* in the example of FIG. 8, can be made synchronous with the read-out operations. For example, read-out operations on waveform 81*d* are performed at a first read-out time 83*a*, a second read-out time 83*b* and a third read-out time 83*c*, as shown in FIG. 8.

As explained above, signals from excitation coil 22*c* and two detection coils 22*a* and 22*b* can be made synchronous with an internal signal of microcomputer 40 in controller 20, thereby making it possible to synchronously perform read-out operations on a signal obtained by rectifying and smoothing an output voltage of detection coil 22*a* and 22*b*.

In this way, a consistency or stability of detected data can be enhanced to achieve a high accuracy vibration detection.

Although the present invention has been described with regard to the embodiments where displacement detection sensor 22 is installed in a vertical direction, the present invention should not be construed to be limited thereto. For example, displacement detection sensor 22 may be installed in a horizontal direction or in a slanted direction such that it can detect a horizontally two-dimensional displacement.

Further, although the present invention has been described with regard to the embodiments where the coils of displacement detection sensor 22 is winded to be overlapped by one another, the present invention should not be construed to be limited thereto. It is also possible to wind the coils of displacement detection sensor 22 in such a manner that the coils of displacement detection sensor 22 have an axis in common.

As can be seen above, the washing machine in accordance with the present invention can implement a low-noise washing machine for domestic or commercial use, because it can restrain vibration and noise thereof by effectively detecting imbalance in laundry to control rotation of a motor, especially in a drum-type washing machine.

While the invention has been shown and described with respect to the preferred embodiments, it will be understood by those skilled in the art that various changes and modification may be made without departing from the spirit and scope of the invention as defined in the following claims.

What is claimed is:

1. A washing machine comprising:

a rotary drum for accommodating therein laundry, the rotary drum having a horizontal or slanted rotational axis;

a water tub supported in a vibratable manner in a washing machine main body, the rotary drum being installed in the water tub in a rotatable manner;

a motor for driving the rotary drum;

an input setting unit for setting an operation of the washing machine;

a control unit for controlling the motor and the operation of the washing machine set by the input setting unit, the control unit including a microcomputer; and a displacement detection unit for detecting a displacement of the water tub, the displacement detection unit including an excitation coil, at least two detection coils having an axis coaxially aligned with the excitation coil and a core which can move along the axis, wherein one of the detection coils and the core can move pursuant to the displacement of the water tub, wherein an end of the excitation coil is coupled to an end of each of said at least two detection coils, forming a neutral point connecting to a 0V voltage reference of a power of the microcomputer, and wherein the other end of the excitation coil is coupled to an oscillation circuit for applying a voltage having a specific waveform to the excitation coil, and the other end of each of said at least two detection coils is coupled to the microcomputer via a detection circuit for half-wave rectifying and smoothing a waveform generated by each of said at least two detection coils.

2. The washing machine of claim 1, wherein the voltage applied to the excitation coil has a triangular waveform.

3. The washing machine of claim 1, wherein the voltage applied to the excitation coil has a sinusoidal waveform.

4. The washing machine of claim 1, wherein the voltage applied to the excitation coil has a square waveform.

5. The washing machine of claim 1, wherein the control unit provides a synchronizing signal, which is synchronous with an internal clock of the microcomputer, to the excitation coil, output signals of the detection coils being read in a manner synchronous with the synchronizing signal.

* * * * *